US011098687B2

(12) United States Patent
Kaneda et al.

(10) Patent No.: US 11,098,687 B2
(45) Date of Patent: Aug. 24, 2021

(54) ENGINE STARTING DEVICE

(71) Applicant: Mitsubishi Electric Corporation, Tokyo (JP)

(72) Inventors: Naohito Kaneda, Tokyo (JP); Naoki Imamura, Tokyo (JP); Koichiro Kamei, Tokyo (JP); Kazuhiro Odahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/609,131

(22) PCT Filed: May 8, 2018

(86) PCT No.: PCT/JP2018/017811
§ 371 (c)(1),
(2) Date: Oct. 28, 2019

(87) PCT Pub. No.: WO2018/212020
PCT Pub. Date: Nov. 22, 2018

(65) Prior Publication Data

US 2020/0200137 A1 Jun. 25, 2020

(30) Foreign Application Priority Data

May 18, 2017 (JP) ..... JP2017-099011

(51) Int. Cl.
*F02N 11/00* (2006.01)
*F02N 11/04* (2006.01)
(Continued)

(52) U.S. Cl.
CPC ..... *F02N 11/006* (2013.01); *F02N 11/00* (2013.01); *F02N 11/04* (2013.01); *F02N 11/08* (2013.01);
(Continued)

(58) Field of Classification Search
CPC .... F02N 11/0855; F02N 11/04; F02N 15/067; F02N 2200/041; F02N 2200/021; F02N 11/0818; F02N 2200/022
See application file for complete search history.

(56) References Cited

U.S. PATENT DOCUMENTS 6,396,165 B1 * 5/2002 Nagano ..... B60K 6/42 290/40 R
9,422,906 B2 * 8/2016 Kees ..... B60K 6/485
(Continued)

FOREIGN PATENT DOCUMENTS

DE 10318848 A1 * 7/2004 ..... F02N 11/108
DE 102016121543 A1 5/2017
(Continued)

OTHER PUBLICATIONS

International Search Report for PCT/JP2018/017811 filed Aug. 7, 2018 [PCT/ISA/210].
(Continued)

*Primary Examiner* — Kevin R Steckbauer
(74) *Attorney, Agent, or Firm* — Sughrue Mion, PLLC; Richard C. Turner

(57) ABSTRACT

There is provided an engine starting device, including: a motor generator coupled to a crankshaft of an engine; and a starter including a pinion provided in a detachable manner from a ring gear provided on the crankshaft, and configured to mesh with the ring gear when the engine is started, wherein the engine is cranked through simultaneous cranking by both of the motor generator and the starter when a condition set in advance is satisfied, and wherein, in the simultaneous cranking, the starter starts rotating after the motor generator starts rotating.

6 Claims, 2 Drawing Sheets

(51) Int. Cl.
*F02N 11/08* (2006.01)
*F02N 15/06* (2006.01)

(52) U.S. Cl.
CPC ..... *F02N 11/0848* (2013.01); *F02N 11/0851* (2013.01); *F02N 11/0855* (2013.01); *F02N 15/067* (2013.01); *F02N 11/087* (2013.01); *F02N 11/0814* (2013.01); *F02N 11/0818* (2013.01); *F02N 2200/021* (2013.01); *F02N 2200/022* (2013.01); *F02N 2200/041* (2013.01)

(56) References Cited

U.S. PATENT DOCUMENTS 9,677,527 B2 * 6/2017 Kees ..... F02N 11/0862
9,982,647 B2 * 5/2018 Imura ..... F02N 11/0844
10,533,528 B2 * 1/2020 Yamamoto ..... B60K 6/48
10,865,757 B2 * 12/2020 Nakaoka ..... F02N 15/04
10,961,970 B1 * 3/2021 Lew ..... F02M 35/10222
2003/0197384 A1 * 10/2003 Vuk ..... F02N 11/006 290/38 R
2011/0118078 A1 * 5/2011 Kraska ..... B60W 10/02 477/5
2011/0139108 A1 * 6/2011 Hashim ..... F02N 11/0855 123/179.3
2012/0031231 A1 * 2/2012 Schoenek ..... F02N 15/067 74/7 C
2015/0096518 A1 * 4/2015 Creviston ..... F02N 11/0844 123/179.4
2015/0224984 A1 * 8/2015 Kees ..... F02N 11/04 701/22
2015/0226171 A1 * 8/2015 Kees ..... B60W 30/194 290/31
2017/0204828 A1 * 7/2017 Imura ..... F02N 11/0855
2019/0145368 A1 * 5/2019 Nakaoka ..... F02N 15/04 123/179.3
2019/0390640 A1 * 12/2019 Ishida ..... H02K 7/14

FOREIGN PATENT DOCUMENTS

DE 102016121543 A1 * 5/2017 ..... F02N 11/006
EP 2907716 A2 8/2015
FR 2839119 A1 10/2003
JP 11-082259 A 3/1999
JP 2000-161102 A 6/2000
JP 2003-328907 A 11/2003
JP 2004-245121 A 9/2004
JP 2004245121 A * 9/2004
JP 2006-075196 A 3/2006
JP 2013-193551 A 9/2013
JP 2013-194584 A 9/2013
JP 2013193551 A * 9/2013
JP 2016-108990 A 6/2016
JP 2018145833 A * 9/2018 ..... H02K 7/1815
WO 2013/035165 A1 3/2013

OTHER PUBLICATIONS

Communication dated Apr. 22, 2020, from the European Patent Office in application No. 18803126.4.

* cited by examiner

ENGINE STARTING DEVICE

CROSS REFERENCE TO RELATED APPLICATIONS

This application is a National Stage of International Application No. PCT/JP2018/017811 filed May 8, 2018, claiming priority based on Japanese Patent Application No. 2017-099011 filed May 18, 2017.

TECHNICAL FIELD

The present invention relates to an engine starting device, which includes a motor generator coupled to a crankshaft of an engine, and a starter configured to cause a pinion to mesh with a ring gear when the engine is started, and is configured to activate at least one of the motor generator and the starter to crank the engine.

BACKGROUND ART

Hitherto, there has been known a vehicle, which is configured to carry out engine automatic stopping/restarting control of automatically stopping an engine when an engine stopping condition is satisfied and to restart the engine when an engine restarting condition is subsequently satisfied, and includes a motor generator and a starter, which are configured to crank the engine when the engine is started.

In such a vehicle, in the cranking at the starting of the engine, the engine is started by selectively using the motor generator and the starter in accordance with a state, or by simultaneously using the motor generator and the starter.

There has been known an engine starting system (see, for example, Patent Literature 1) including a gear starter, which is a starter configured to mesh a pinion gear with a ring gear coupled to a crankshaft so as to apply motor drive, to thereby rotate the crankshaft, and a belt starter, which is a motor generator configured to apply motor drive, via a belt, to a crank pulley provided on a side opposite to the ring gear, to thereby rotate the crank shaft, in which, when a torque required for staring an engine is high, the gear starter and the belt starter are caused to cooperate with each other so as to crank the engine.

In the engine starting system described in Patent Literature 1, when the gear starter and the belt starter are caused to cooperate with each other, to thereby crank the engine, the gear starter and the belt starter are simultaneously activated, or the gear starter is activated with priority over the belt starter.

Moreover, there has been known a starting device for a vehicle-mounted engine (see, for example, Patent Literature 2) including a low-speed type starter motor, which is a starter having a relatively higher rotation of a motor output shaft with respect to a rotation of a crankshaft, and a high-speed type starter motor, which is a motor generator having a relatively lower rotation of a motor output shaft with respect to the rotation of the crankshaft, in which, when a start request from a driver is given upon a restart of an engine, the low-speed type starter motor and the high-speed type starter motor are driven so as to crank the engine.

In the starting device for a vehicle-mounted engine described in Patent Literature 2, when the low-speed type starter motor and the high-speed type starter motor are driven so as to crank the engine, the low-speed type starter motor and the high-speed type starter motor may simultaneously be driven, but it is considered more preferable that the high-speed type starter motor be driven with a delay after the low-speed type starter motor is driven.

CITATION LIST

Patent Literature

[PTL 1] JP 2003-328907 A
[PTL 2] JP 2013-194584 A

SUMMARY OF INVENTION

Technical Problem

However, the related art has the following problem.

That is, in the engine starting system described in Patent Literature 1 and the starting device for a vehicle-mounted engine described in Patent Literature 2, the pinion meshes with the ring gear provided on the crankshaft of the stopped engine, and an impact equivalent to that of the meshing in the related art is to be received.

That is, there is such a problem that strength and durability equivalent to those of a related-art starter are required for the meshing between the pinion and the ring gear even when both of the motor generator and the starter are used to start the engine.

Moreover, upon the start of the drive of the starter, there is a time lag between application of a voltage to an excitation terminal of an electromagnetic switch, which is configured to push out the pinion of the starter and close an electric contact configured to supply power to the motor part of the starter, and start of the rotation by movement of an internal movable core to close the electric contact. Therefore, the motor generator needs to wait during this period, and there is also such a problem that a loss of the start period occurs.

The present invention has been made in view of the above-mentioned problems, and has an object to provide an engine starting device configured to optimize the rotation start timings of the motor generator and the starter in the simultaneous cranking of the engine through use of both of the motor generator and the starter, thereby being capable of achieving a long life and a cost reduction through a reduction in meshing impact, and a reduction in the start period.

Solution to Problem

According to one embodiment of the present invention, there is provided an engine starting device, including: a motor generator coupled to a crankshaft of an engine; and a starter including a pinion provided in a detachable manner from a ring gear provided on the crankshaft, and configured to mesh with the ring gear when the engine is started, wherein the engine is cranked through simultaneous cranking by both of the motor generator and the starter when a condition set in advance is satisfied, and wherein, in the simultaneous cranking, the starter starts rotating after the motor generator starts rotating.

Advantageous Effects of Invention

With the engine starting device according to the present invention, when the condition set in advance is satisfied, the engine is cranked thorough the simultaneous cranking with both of the motor generator and the starter, thereby starting the rotation of the starter after the motor generator starts rotating in the simultaneous cranking.

Therefore, through optimization of the rotation start timings of the motor generator and the starter in the simultaneous cranking of the engine through use of both of the motor generator and the starter, it is possible to achieve a long life and a cost reduction through a reduction in meshing impact, and a reduction in the start period.

DESCRIPTION OF EMBODIMENTS

Figure 1:
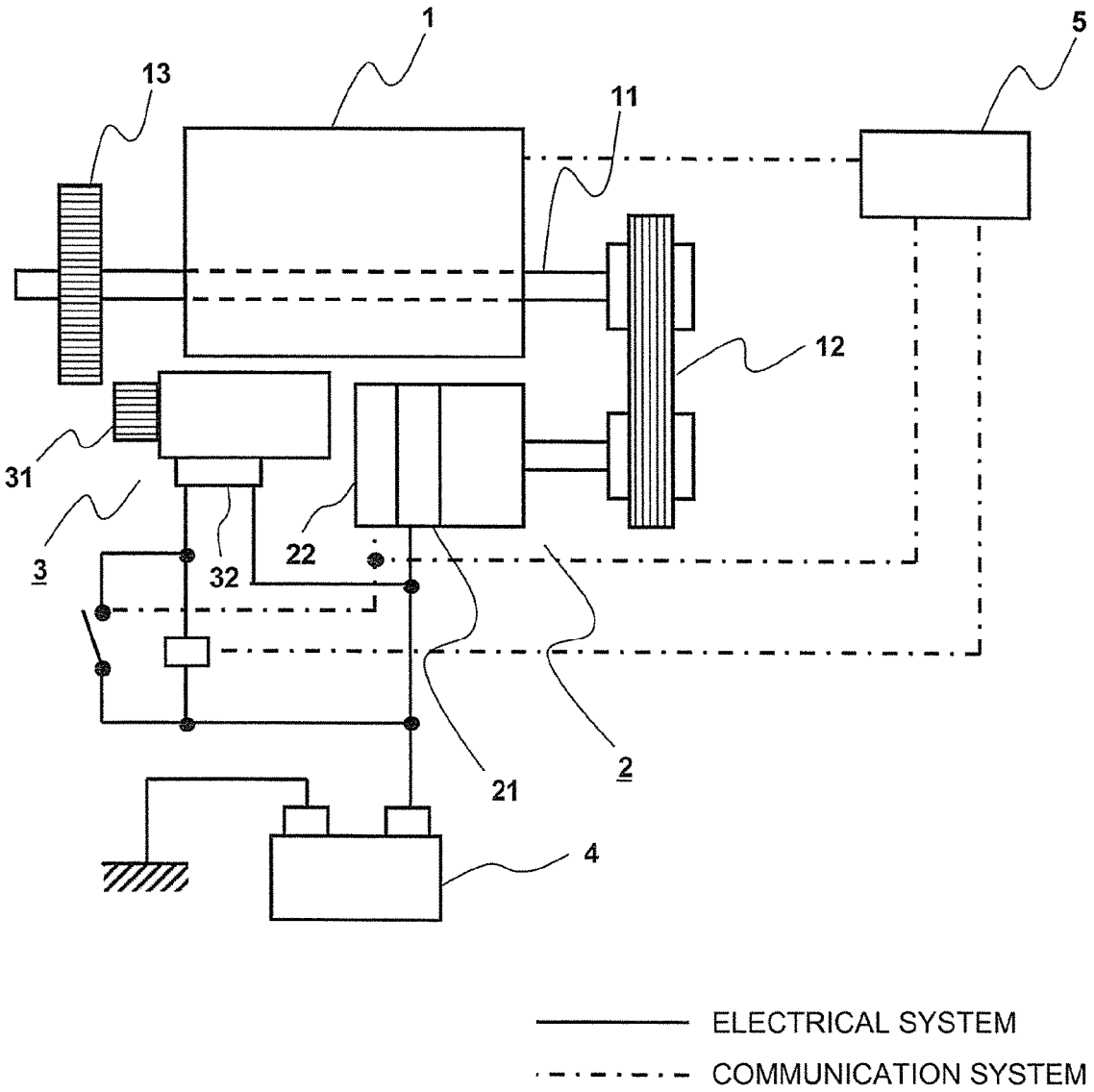
FIG. 1 is a block diagram for illustrating a schematic configuration of a vehicle in which an engine starting device according to a first embodiment of the present invention is installed.

A description is now given of an engine starting device according to a preferred embodiment of the present invention with reference to the accompanying drawings. Throughout the drawings, like or corresponding components are denoted by like reference numerals to describe those components.

First Embodiment

FIG. 1 is a block diagram for illustrating a schematic configuration of a vehicle in which an engine starting device according to a first embodiment of the present invention is installed. In FIG. 1, an engine 1 is controlled for drive by an engine control device 5, which has a function of determining engine stopping or engine restarting of engine automatic stopping/restarting control, and is configured to control the engine 1. The engine control device 5 is hereinafter referred to as "engine ECU 5".

A motor generator 2 is always coupled to a crankshaft 11 of the engine 1 via a belt 12. Moreover, a pinion 31 serving as a part configured to output a rotation torque of the starter 3 is provided in a detachable manner from a ring gear 13, which is integrated with the crankshaft 11, to transmit the rotation torque to the ring gear 13.

A power conversion device 21 is connected to the motor generator 2. Moreover, the power conversion device 21 is connected to a battery 4 and a motor generator control circuit 22 configured to control regeneration and power running of the motor generator 2. The motor generator control circuit 22 is hereinafter referred to as "MG control circuit 22".

The starter 3 includes an electromagnetic switch 32 having a function of opening/closing an electric contact 32*c* for supplying power to the starter 3. Moreover, the electromagnetic switch 32 is connected to the battery 4. A signal representing the starting of the engine is input to each of an input terminal of the MG control circuit 22 and an excitation terminal of the electromagnetic switch 32.

Further, the engine 1 includes a crank angle sensor (not shown) configured to detect a rotation angle of the crankshaft 11. A crank angle signal from the crank angle sensor is transmitted to the engine ECU 5, and is used for calculation to derive a rotation speed of the crankshaft 11 of the engine 1.

A description is now given of functions of the motor generator 2. The motor generator 2 has two functions, namely, a function of power generation, which is the regeneration, and a function of motor drive, which is the power running. On this occasion, the regeneration corresponds to a case in which the engine 1 is in an operation state, and the motor generator 2 rectifies generated power through the power conversion device 21 controlled by the MG control circuit 22, thereby charging the battery 4 while being always rotated by a rotation torque of the engine 1 transmitted from the crankshaft 11 via the belt 12.

Moreover, the power running corresponds to a case in which the rotation torque is supplied to the engine 1, and the motor generator 2 uses power of the battery 4, and receives power supply via the power conversion device 21 controlled by the MG control circuit 22 to be driven as a motor. Further, the rotation torque is transmitted to the crankshaft 11 via the belt 12, thereby driving the engine 1.

The function of the motor generator 2 is switched from the power running to the regeneration after the starting of the engine 1 is completed. Moreover, the case in which the rotation torque is to be supplied to the engine 1 includes a case in which the engine 1 is cranked, a case of torque assist in which the torque generated by the engine 1 in the operation state is assisted, and a case of electric travel in which the vehicle is moved only by the motor generator 2 even when the engine 1 is stopped.

A description is now given of functions of the starter 3. The starter 3 is used when the engine 1 is cranked. Voltage is applied to the excitation terminal of the electromagnetic switch 32, thereby closing the electric contact 32*c* of the electromagnetic switch 32. The power is thus supplied to a motor part of the starter 3, and the pinion 31 moves to the ring gear 13 side. Subsequently, the ring gear 13 and the pinion 31 mesh with each other, thereby transmitting the rotation torque generated by the motor part of the starter 3 to the crankshaft 11, and the engine 1 is consequently driven.

An output shaft 36 of the motor part and a pinion moving body including the pinion 31 are engaged with each other through a helical spline having an angle of generating a propulsion force for the pinion moving body from a stationary position toward the ring gear 13 side when the motor part is driven for rotation.

Moreover, when the rotation torque of the starter 3 is no longer required on the engine 1 side, the application of the voltage to the excitation terminal is cancelled. As a result, the state in which the pinion 31 and the ring gear 13 mesh with each other is cancelled, and the electric contact 32*c* of the electromagnetic switch 32 is simultaneously opened. The power supply to the motor part of the starter 3 is thus stopped.

A description is now given of a series of operations in which both of the motor generator 2 and the starter 3 are simultaneously used to crank the engine 1 to start the engine 1 in the engine starting device according to the first embodiment of the present invention.

The engine ECU 5 is configured to execute the simultaneous cranking by both of the motor generator 2 and the starter 3 when a condition set in advance is satisfied. In this configuration, the condition set in advance includes a case in which a start operation is executed by the driver and a case in which a restart condition is satisfied after engine automatic stop.

When the condition for the engine start through the simultaneous cranking is satisfied, a voltage is applied to the excitation terminal of the electromagnetic switch 32 by a predetermined electric signal, thereby driving the electromagnetic switch 32 to close the electric contact 32*c*. As a result, current is supplied to the motor part of the starter 3 though current supply to a motor circuit, and the rotation torque is thus generated in the motor part. The starter 3 is consequently activated.

Moreover, the electromagnetic switch 32 is driven to move the pinion 31 to a position at which the pinion 31 meshes with the ring gear 13. As a result, the rotation torque of the motor part is transmitted to the crankshaft 11 via the pinion 31 and the ring gear 13 meshing with each other, and the engine 1 is thus cranked. Subsequently, fuel injection is started.

Further, the electric signal is transmitted also to the MG control circuit 22, and the MG control circuit 22 uses the power of the battery 4 to supply the power to the motor generator 2 via the power conversion device 21 controlled by the MG control circuit 22 in order to activate the motor generator 2 for the power running. As a result, the motor generator 2 is driven for the power running, thereby transmitting the rotation torque to the crankshaft 11 via the belt 12, and the engine 1 is consequently cranked.

During such cranking of the engine 1, the engine ECU 5 calculates and monitors the rotation speed of the engine 1, namely, a rotation speed of the ring gear 13, based on a current crank angle obtained from a crank angle signal transmitted from the crank angle sensor and on a cycle of the crank angle signal.

On this occasion, the engine ECU 5 determines based on the rotation speed of the engine 1 whether or not the rotation speed of the engine 1 has become equal to or more than a rotation speed set in advance and the engine 1 has entered a complete combustion state, that is, whether or not the engine 1 has entered the operation state and the starting of the engine 1 has been completed. When the engine 1 has not entered the complete combustion state, the engine ECU 5 maintains the state and waits until the engine 1 is determined to have entered the complete combustion state.

Meanwhile, as a result of the determination, when the engine 1 has entered the complete combustion state, the engine ECU 5 stops the starter 3. Specifically, the state in which the pinion 31 and the ring gear 13 mesh with each other is cancelled, the electric contact 32*c* of the electromagnetic switch 32 is simultaneously opened, and the power supply to the motor part of the starter 3 is thus stopped. Moreover, simultaneously, the engine ECU 5 stops the power supply to the motor generator 2 through the MG control circuit 22, thereby stopping the power running.

As a result of the series of those operations, the processing of cranking the engine 1 by simultaneous use of both of the motor generator 2 and the starter 3 to start the engine 1 is finished.

A description is now given of timings relating to the rotation starts of the motor generator 2 and the starter 3 in the above-mentioned simultaneous cranking.

When the engine start condition through the simultaneous cranking is satisfied, and the electric signals are transmitted to the electromagnetic switch 32 of the starter 3 and the MG control circuit 22 of the motor generator 2, the starter 3 and the motor generator 2 start rotating. On this occasion, the starter 3 starts rotating after the motor generator 2 starts rotating.

With the engine starting device having such a configuration, by the time when the starter 3 starts rotating, the motor generator 2 has started rotating. Therefore, when a rotation torque is transmitted from the pinion 31 of the starter 3 to the ring gear 13, the ring gear 13 also has started rotating by the motor generator 2, and a meshing impact is reduced compared with a case of meshing with the stopped ring gear 13.

In this configuration, also the ring gear 13 only needs to have started rotating when the starter 3 starts rotating, and the rotation start of the starter 3 and the rotation start of the motor generator 2 may thus be simultaneous. However, in the case in which the rotation starts are simultaneous, when the starter 3 has a higher acceleration on a rise of the rotation speed than the motor generator 2, a larger impact of the meshing occurs than that given in the case in which the rotation start of the starter 3 is sufficiently delayed.

However, the effect of the reduction in impact can sufficiently be obtained compared with the case of the meshing with the stopped ring gear 13. Further, the period of the engine start can be shortened when the motor generator 2 starts rotating before the starter 3 starts rotating.

There may be provided such a configuration that the motor generator 2 starts rotating after a pinion push-out mechanism of the starter 3 pushes out the pinion 31, and an end face of the pinion 31 on a ring gear 13 side is brought into abutment against an end face of the ring gear 13 on a pinion 31 side, and the starter 3 then starts rotating after the motor generator 2 starts rotating.

For example, even when the rotation start of the motor generator 2 is excessively early, the meshing impact is still reduced. However, when the rotation speed of the ring gear 13 is excessively high upon the abutment of the pinion 31 of the start 3 against the ring gear 13, there arise a fear in that the meshing may be hindered, that is, the meshing may not occur.

Therefore, as a result of the start of the rotation of the motor generator 2 after the end face of the pinion 31 on the ring gear 13 side is brought into abutment against the end face of the ring gear 13 on the pinion gear 31 side, when the motor generator 2 starts rotating, the pinion 31 is held in abutment against the end face of the ring gear 13, is thus ready for the meshing, and can stably mesh after the motor generator 2 starts rotating, that is, after the ring gear 13 starts rotating.

As described above, with the engine starting device according to the first embodiment, when the condition set in advance is satisfied, the engine is cranked thorough the simultaneous cranking by both of the motor generator 2 and the starter 3, thereby starting the rotation of the starter 3 after the motor generator 2 starts rotating in the simultaneous cranking.

Therefore, through optimization of the rotation start timings of the motor generator 2 and the starter 3 in the simultaneous cranking of the engine through use of both of the motor generator 2 and the starter 3, it becomes possible to achieve a long life and a cost reduction through a reduction in meshing impact, and a reduction in the start period.

Second Embodiment

Figure 2:
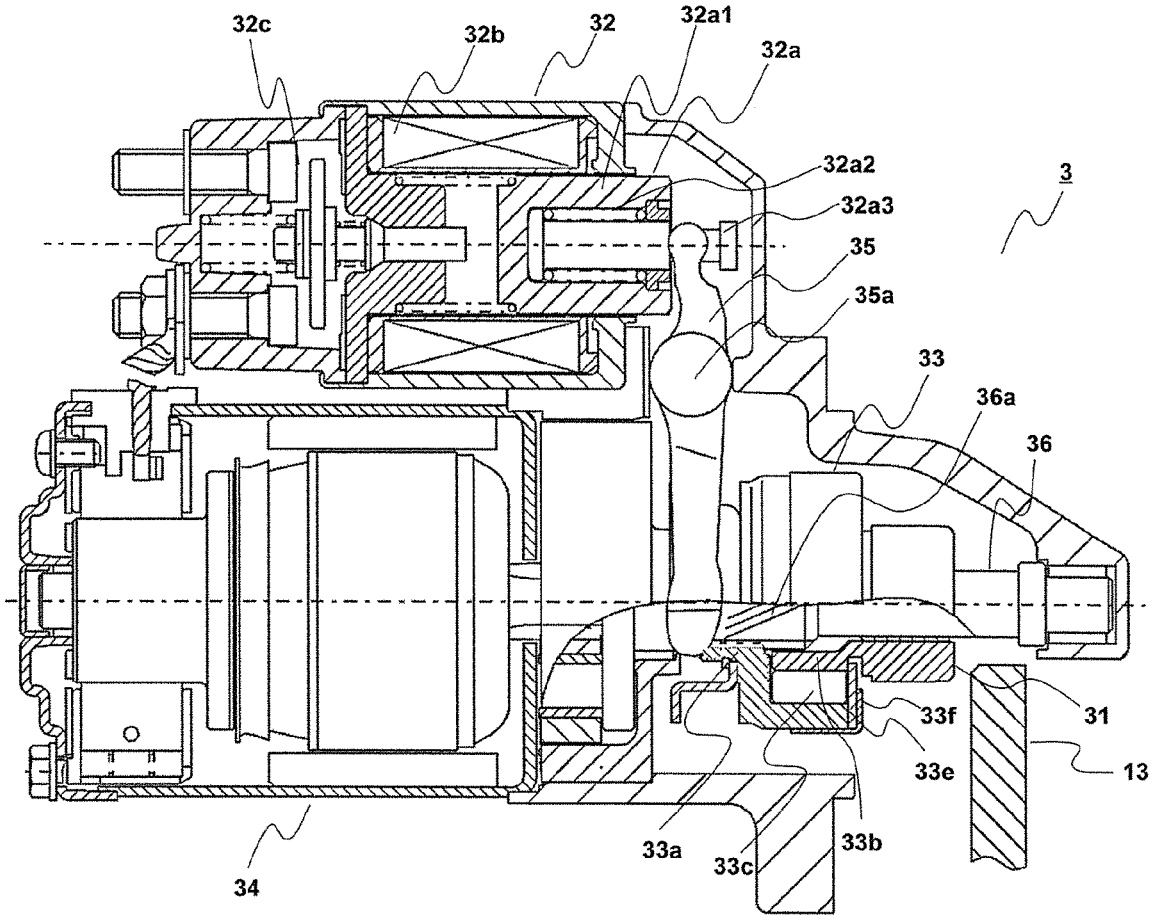
FIG. 2 is a sectional view for illustrating a starter of the engine starting device according to the first embodiment of the present invention.

FIG. 2 is a sectional view for illustrating the starter 3 of the engine starting device according to the first embodiment of the present invention. In FIG. 2, the starter 3 includes the pinion 31, the electromagnetic clutch 32, a one-way clutch 33, and a motor part 34.

The one-way clutch 33 includes a helical spline part 33*a* configured to fit to a helical spline 36*a* formed integrally with the output shaft 36, and is coupled to the output shaft 36 through intermediation of the helical spline 36*a* on the output shaft 36 so as to be slidable in an axial direction.

Moreover, the helical spline 36*a* is formed so as to be twisted in a predetermined direction at a helix angle θ. When the one-way clutch 33 moves in the direction toward the ring gear 13, the one-way clutch 33 fitted to the helical spline 36*a* moves while rotating in a direction opposite to a rotation direction of the motor part 34.

The one-way clutch 33 runs idle when a rotation torque from the ring gear 13 is input thorough the pinion 31, and hence the rotation torque from the ring gear 13 is not transmitted to the output shaft 36.

Moreover, a movable core 32*a* of the electromagnetic switch 32 is configured to move in a direction toward the electric contact 32*c* when a voltage is applied to a drive coil 32*b* configured to generate magnetic field. A hook 32*a*3 capable of pulling a lever 35 configured to push out the pinion 31 is provided on the movable core 32*a* on a side opposite to an electric contact 32*c* side.

As the movable core 32*a* moves, the lever 35 slides about a fulcrum 35*a* of the lever 35, thereby being capable of pushing out a pinion moving body including the one-way clutch 33 and the pinion 31 toward the ring gear 13 side. The mechanism described above is referred to as "pinion push-out mechanism".

Moreover, the movable core 32*a* is formed of a core 32*a*1, a coil spring 32*a*2, and the hook 32*a*3. After the pinion 31 is pushed out toward the ring gear 13 side by the pinion push-out mechanism, and is brought into abutment against the ring gear 13, the core 32*a*1 continues to move toward the electric contact 32*c* side while deflecting the coil spring 32*a*2, and consequently closes the electric contact 32*c*. As a result of the closure of the electric contact 32*c*, power is supplied to the motor part 34, and the motor 34 thus starts rotating.

With the starter 3 having such a configuration, when the movable core 32*a* starts moving under the state in which the pinion 31 is being pushed out, static inertia of the hook 32*a*3, the lever 35, the one-way clutch 33, and the pinion 31 acts on the coil spring 32*a*2, and the coil spring 32*a*2 pushes out the pinion 31 while being deflected.

On this occasion, when a load of the coil spring 32*a*2 is small compared with the static inertia, the deflection of the coil spring 32*a*2 increases, the electric contact 32*c* may close before the pinion 31 is brought into against the ring gear 13, and the starter 3 may start rotating.

In the first embodiment, the meshing impact is reduced under such a condition that Expression (1) is satisfied, where T1 represents a time point at which the pinion gear 31 is brought into abutment against the ring gear 13, T2 represents a time point at which the motor generator 2 starts rotating, and T3 represents a time point at which the starter 3 starts rotating.

$$T2 \leq T3 \quad (1)$$

That is, Expression (1) is irrelevant of the timing of T1, and hence the meshing impact is reduced even when T3≤T1 is given. Therefore, the coil spring 32*a*2, which has a low load, may be used.

However, in the first embodiment, a stable meshing can be achieved under such a condition that Expression (2) is satisfied as another relationship.

$$T1 \leq T2 \quad (2)$$

Thus, it is preferred that a relationship of T1≤T2≤T3 be satisfied from Expression (1) and Expression (2).

Therefore, it is preferred that the coil spring 32*a*2 have such a load as closing the electrical point 32*c* after the pinion 31 is brought into abutment against the ring gear 13, and the starter 3 thus starts rotating. That is, when the pinion 31 is pushed out, it is preferred that the load of the coil spring 32*a*2 be such that a deflection equal to or larger than a certain deflection is not caused by the static inertia. The relationship of T1≤T2≤T3 can be secured by appropriately setting the load of the coil spring 32*a*2 based on the static inertia.

From Expression (1) and Expression (2), even when T1=T2=T3 is given, such a stable meshing that the meshing impact is reduced can be achieved, but a relationship of T1<T3 is preferred in consideration of a variation of the operation. That is, it is preferred that a certain time difference be present between the abutment of the pinion 31 against the ring gear 13 and the rotation start of the starter 3. Moreover, the motor generator 2 only needs to start rotating between T1 to T3.

The starter 3 having such a configuration provides the mechanism configured to close the electric contact 32*c*, to thereby rotationally drive the motor part 34 after the pinion 31 is brought into abutment against the ring gear 13. Therefore, the pinion 31 does not start meshing with the ring gear 13 while rotating, and the stable meshing can thus be achieved.

Moreover, the coil spring 32*a*2 is provided at one or more locations anywhere in the pinion push-out mechanism, that is, in the movable core 32*a*, the lever 35, the one-way clutch 33, and the pinion 31, and only needs to be set to a load equal to or higher than such a load that the starter 3 starts rotating after the abutment of the pinion 31 against the ring gear 13 by the static inertia of the pinion push-out mechanism.

As a result, in the simultaneous cranking of the engine 1 through use of both of the motor generator 2 and the starter 3, it is possible to achieve a long life and a cost reduction through a reduction in meshing impact, and a reduction in the start period.

In a second embodiment described above, the coil spring 32*a*2 only needs to be capable of elastically deflecting. The coil spring 32*a*2 is not limited to the spring in the coil shape, may be an elastic body such as rubber, and only needs to be a buffer member.

Moreover, the core 32*a*1 becomes movable as a result of the deflection of the coil spring 32*a*2 after the pinion 31 is brought into abutment against the ring gear 13. However, when the load of the coil spring 32*a*2 is higher than a magnetic attraction force for moving the core 32*a*1, the core 32*a*1 cannot move, and such a state that the electric contact 32*c* cannot be closed is brought about.

However, with the second embodiment of the present invention, the motor generator 2 starts rotating after the pinion 31 is brought into abutment against the ring gear 13, the pinion 31 is further pushed out when the ring gear 13 rotates with respect to the stopped pinion 31, and reaches such a position as being capable of meshing with the pinion 31, and the movable core 32*a* resumes moving, and closes the electric contact 32*c*, thereby being capable of starting the rotation of the starter 3.

As described above, the load of the coil spring 32*a*2 may be such a load as being capable of maintaining the state in which the electric contact 32*c* is opened when the pinion 31 is held in abutment against the ring gear 13, and the pinion 31 cannot further be pushed out. In this case, there is provided such a configuration that the starter 3 starts rotating after the pinion 31 is reliably brought into abutment against the ring gear 13.

Moreover, as the configuration capable of maintaining the state in which the electric contact 32*c* is opened when the pinion 31 is held in abutment against the ring gear 13, and the pinion 31 cannot thus further be pushed out, there may be provided such a configuration that the coil spring 32*a*2 is not provided, and the core 32*a*1 and the hook 32*a*3 thus move integrally with one another.

In the first embodiment and the second embodiment, when the electric signals for the activation are simultaneously transmitted to the motor generator 2 and the starter 3, the system for the engine starting does not become complex, complex starting control is not necessary either, and a stable engine starting device can be obtained.

In this configuration, in a case in which the electric signals are simultaneously transmitted, and the rotation start of the motor generator 2 becomes earlier, the operation of the starter 3 is executed after elapse of a period in which mechanical stability is established, and control of starting the rotation of the motor generator 2 after elapse of a predetermined period can be added in the MG control circuit 22.

Moreover, when the timings of transmitting the electric signals to the motor generator 2 and the starter 3 can be simultaneous, the simultaneous cranking can be executed by transmitting the voltage applied to the electromagnetic switch 32 of the starter 3, as an electric signal, to the MG control circuit 22 without use of other control functions also during the initial starting of starting the engine 1 through the starting operation by the driver.

In the embodiments, the electromagnetic switch 32 is configured to push out the pinion 31 and close the electric contact 32*c* as the one movable core 32*a* moves, but may be configured to push out the pinion 31 and close the electric contact 32*c* independently.

Further, the following mechanism may be provided. Specifically, between an end face on the ring gear 13 side of the pinion 31 and each tooth face on a non-torque transmission side of the pinion 31, a tooth face chamfered part may be formed as a curved shape along the tooth face, and further, a tooth tip chamfered part may be formed along a tooth tip outer diameter on each tooth tip outer diameter part of the pinion 31. In this case, the tooth face chamfered part is formed of the curved face along the tooth face on the non-torque transmission side, and hence this state is the same as a state in which the teeth of the ring gear 13 and the teeth of the pinion 31 always mesh with each other on a cross section perpendicular to an axial direction of the ring gear 13 and the pinion 31.

When the state is not the same as the state in which the teeth mesh with each other, speed vectors of the respective teeth of the ring gear 13 and the pinion 31 are different from each other. Therefore, as a result, a contact position shifts in the axial direction, and hence not only a stable rotation force is not transmitted, but also the rotation force may forma repelling force, resulting in an unstable meshing state.

In other words, even when the motor generator 2 starts the rotation earlier, the stable meshing of the ring gear 13 and the pinion 31 can be achieved by forming the tooth face chamfered part as the curved shape along the tooth face between the end face on the ring gear 13 side of the pinion 31 and the tooth face on the non-torque transmission side of the pinion 31.

Moreover, in the description of the first embodiment and the second embodiment, it is assumed that the motor generator 2 is always coupled to the crankshaft 11 of the engine 1 via the belt 12, and simultaneously has the functions of the regeneration and the power running. However, the motor generator 2 may be directly coupled to the crankshaft 11 via gears, or coupled to the crankshaft 11 via an electromagnetic clutch or the like, and the same effect can be obtained also in those cases.

REFERENCE SIGNS LIST

1 engine, 2 motor generator, 3 starter, 4 battery, 5 engine control device (engine ECU), 11 crankshaft, 12 belt, 13 ring gear, 21 power conversion device, 22 motor generator control circuit (MG control circuit), 31 pinion, 32 electromagnetic switch, 32*a* movable core, 32*a*1 core, 32*a*2 coil spring, 32*a*3 hook, 32*b* drive coil, 32*c* electric contact, 33 one-way clutch, 33*a* helical spline part, 34 motor part, 35 lever, 35*a* fulcrum, 36 output shaft, 36*a* helical spline

The invention claimed is:

1. An engine starting device, comprising:

a motor generator coupled to a crankshaft of an engine; and a starter including a pinion provided in a detachable manner from a ring gear provided on the crankshaft, and configured to mesh with the ring gear when the engine is started, and a controller configured to control the motor generator and the starter motor such that:

the engine is cranked through simultaneous cranking by both of the motor generator and the starter by starting rotation of both of the motor generator and the starter when a condition for engine start through simultaneous cranking by both of the motor generator and the starter is satisfied, wherein, in the simultaneous cranking, the starter starts rotating after the motor generator starts rotating, and both the starter and the motor generator both crank the engine together, and are stopped at the same time once a complete combustion state is reached.

2. The engine starting device according to claim 1, wherein the starter includes a pinion push-out mechanism configured to push out the pinion toward a ring gear side, and wherein, in the simultaneous cranking, the motor generator starts rotating after the pinion push-out mechanism pushes out the pinion to bring the pinion into abutment against the ring gear.

3. The engine starting device according to claim 2, wherein the starter includes an electromagnetic switch configured to open and close an electric contact configured to supply power to a motor part of the starter, wherein the starter starts rotating when the electric contact is closed after the pinion push-out mechanism pushes out the pinion to bring the pinion into abutment against the ring gear.

4. The engine starting device according to claim 1, wherein, in the simultaneous cranking, electric signals for activation are simultaneously transmitted to the motor generator and the starter.

5. The engine starting device according to claim 2, wherein, in the simultaneous cranking, electric signals for activation are simultaneously transmitted to the motor generator and the starter.

6. The engine starting device according to claim 3, wherein, in the simultaneous cranking, electric signals for activation are simultaneously transmitted to the motor generator and the starter.

* * * * *